US005180168A

United States Patent [19]

Balestrieri

[11] Patent Number: 5,180,168

[45] Date of Patent: Jan. 19, 1993

[54] PUTTING PRACTICE DEVICE

[76] Inventor: Harry Balestrieri, 12451 N.W. 3rd St. B4, Plantation, Fla. 33325

[21] Appl. No.: 836,753

[22] Filed: Feb. 19, 1992

[51] Int. Cl.[5] ..... A63B 69/36

[52] U.S. Cl. ..... 273/187 R; 273/192

[58] Field of Search ..... 273/187 R, 187 A, 187 B, 273/191 R, 191 A, 191 B, 192, 183 A

[56] References Cited

U.S. PATENT DOCUMENTS

| | | | |
|---|---|---|---|
| 4,384,718 | 5/1983 | Cachola | 273/187 R |
| 4,563,010 | 1/1986 | McDorman et al. | 273/187 R |
| 4,871,175 | 10/1989 | Levin et al. | 273/187 R |
| 5,083,789 | 1/1992 | Hickson | 273/187 R |

OTHER PUBLICATIONS

Golf Magazine, Jan. 1992 edition, Advertisements.

*Primary Examiner*—George J. Marlo
*Attorney, Agent, or Firm*—Fleit, Jacobson, Cohn, Price, Holman & Stern

[57] ABSTRACT

A putting practice device which provides a golfer with a means for maintaining a predetermined putting stance and which ensures that putting strokes are pendulum strokes containing no lateral motion. The putting practice device comprises an elongated L-shaped angle bar with a bearing surface; an elongated central member having a longitudinally disposed slot; and an elongated foot member. The foot member itself is adjustably connected to the central member so that the angular and positional relationship between the foot member and the central member can be selectively adjusted by a golfer. In addition, the central member is connected perpendicularly by one of its ends to the longitudinal center of the elongated angle bar. This latter connection can be made pivotally adjustable to thereby provide a collapsible putting practice device. In use, the practice putting device is positioned on the ground such that the angle bar parallels the intended trajectory of a golf ball, while the central member is perpendicular to the angle bar, and while the foot member is oriented with respect to the elongated central member so as to lie along the golfer's toes. The bearing surface of the the angle bar serves as a guide for the putter head during practice strokes to ensure pendulum strokes.

16 Claims, 3 Drawing Sheets

PUTTING PRACTICE DEVICE

BACKGROUND OF THE INVENTION

The present invention relates to the game of golf, and in particular, relates to a device and method for practicing a putting stance and a putting stroke.

By maintaining a consistent putting stance, it has been found that the accuracy of a golfer's putt can be improved substantially. Typically, the ideal stance for a golfer is the stance which is most comfortable to him/her. An ideal stance therefore may vary from one golfer to the next, with some golfer's preferring a more open stance, while others prefer a more closed stance. Stances may also vary as a consequence of different golfer heights and shoulder widths. In order for a putting practice device to be most effective, it must therefore be adjustable to suit the ideal stance of the golfer and, in addition, should help train the golfer to use his/her ideal stance consistently.

It has further been found that lateral motion (motion perpendicular to the desired trajectory of the ball and parallel to the ground), if present in a putting stroke during impact with the ball, may cause the ball to diverge from the golfer's intended trajectory. To avoid this, a golfer's putting stroke should contain no lateral motion. In this regard, it follows that a putting practice device should train the golfer to consistently use a putting stroke free of lateral motion.

With regard to prior art devices, U.S. Pat. No. 4,871,175 to Levin et al. and U.S. Pat. No. 4,384,718 to Cachola are representative of existing golf training devices.

Specifically, the '718 patent discloses a golf stance and swing practice device comprising three elongated flat strips of material pivotally attached to one another and adjustable to form an I-configuration. The I-configuration is adjustable in height and is also adjustable angularly for a "draw" or "fade" shot. In use, the device is laid flat on the ground and is adjusted according to the desired shot pattern. For full-swing practice, the golf ball is placed just above the top of "I" while the golfer's feet are positioned just below the base of the "I" at a predetermined distance from one another, the distance separating the golfer's feet being measured using indices at the base of the "I". If instead of full-swing practice, putting practice is desired, the patent teaches placing the ball between the top of the "I" and the base of the "I" and setting all angles at 90°.

The '175 provides a similar I-shaped arrangement for full-swing practice, but makes no mention of its use for putting practice. Specifically, the device comprises two separate subassemblies joined together by a sleeve to form the desired I-shape.

Examples of commercially available putting practice devices include the "ON-TRAC PUTTING SYSTEM" as well as the "PING STROKE-IN" putting device.

The "ON-TRAC PUTTING SYSTEM" comprises a T-square mounted by rubber band to a putter, and a wooden board which engages the T-square to keep the face of the putter perpendicular to the direction of the putting stroke. The "PING STROKE-IN" device, on the other hand, comprises an angled metal wall attached to a piece of "ASTROTURF". In use, these devices prevent the golfer from using a lateral motion during his/her stroke. Neither device, however, provides a means for training the golfer to use a consistent stance.

SUMMARY OF THE INVENTION

A primary object of the present invention is to provide a putting practice device which provides a golfer with a means for maintaining a predetermined putting stance, a predetermined stance-to-ball spacing, and which further ensures that putting strokes are pure pendulum strokes of consistent stroke length.

A further object of the present invention is to provide a putting practice device which easily collapses for storage.

In order to accomplish these objects as well as others, the putting practice device of the present invention comprises an elongated L-shaped angle bar with a bearing surface; an elongated central member having a longitudinally disposed slot; and an elongated foot member. The foot member itself is adjustably connected to the central member so that the angular and positional relationship between the foot member and the central member can be selectively adjusted by a golfer. In addition, the central member is connected perpendicularly by one of its ends to the longitudinal center of the elongated angle bar. This latter connection can be made pivotally adjustable to thereby provide a collapsible putting practice device.

To use the practice putting device, the device is first arranged on the ground such that the angle bar parallels the intended trajectory of a golf ball, while the central member is perpendicular to the angle bar. Next, the golfer places the inner side of his putter's head against the bearing surface of the angle bar, places the ball at a predetermined location along the angle bar, and assumes a putting stance which is most comfortable to him/her. The golfer's stance can be a closed stance, an open stance, or a square stance, and should be such that the spacing from the ball to his feet is comfortable. Once the most comfortable stance is achieved, the golfer's foot positioning is marked by orienting the foot member relative to the central member, and locking the elements together by means of hand-adjustable tightening wings so as to prevent movement of the foot member with respect to the elongated central member.

In addition, the putting practice device can further include a series of indices for indicating the positioning of the ball, the length of the stroke, the longitudinal position of the foot member down the central member, and the location of a golfer's feet with respect to the foot member. Further indices may also be used to denote the angular orientation of the foot member with respect to the center member.

DETAILED DESCRIPTION OF A PREFERRED EMBODIMENT

Figure 1:
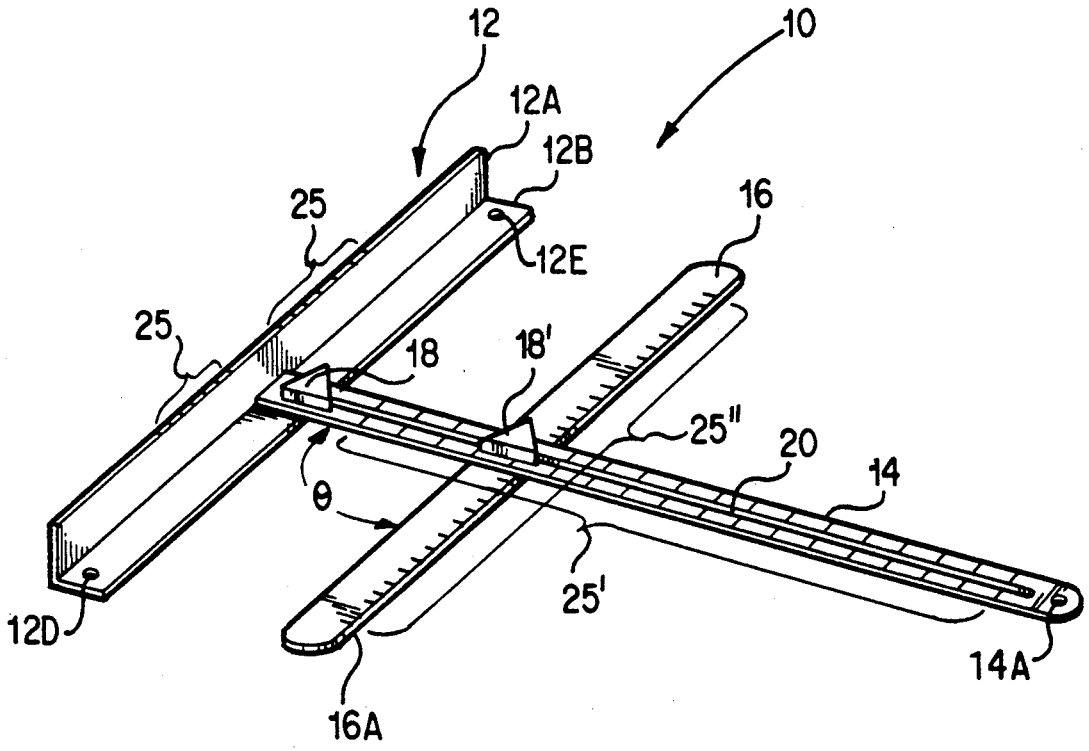
FIG. 1 is perspective view of a preferred embodiment of a putting practice device in accordance with the present invention.
Figure 2:
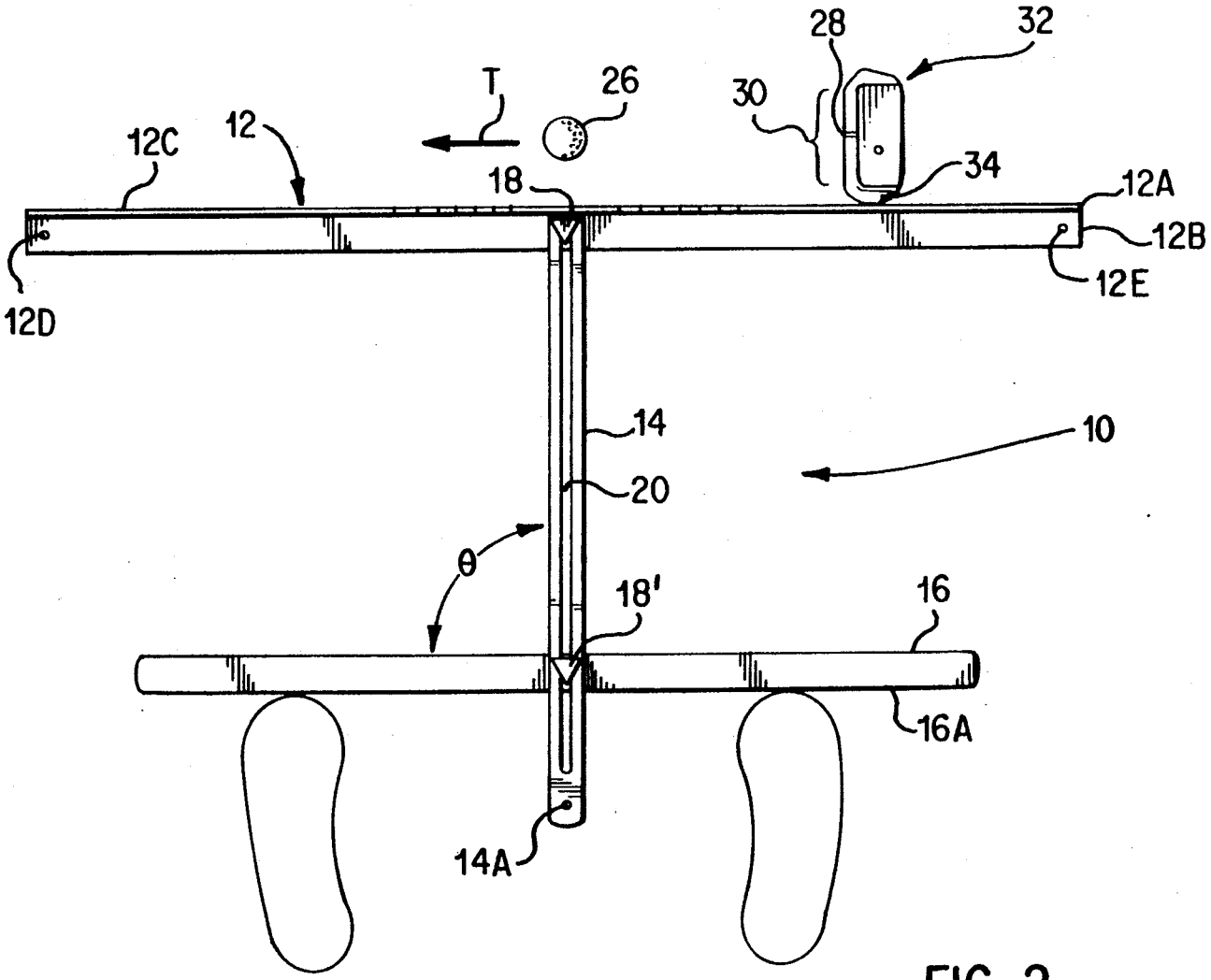
FIG. 2 is a top view of the preferred embodiment illustrated in FIG. 1.

With reference to FIGS. 1 and 2, a preferred embodiment of the putting practice device will now be described. Specifically, the putting practice device is shown generally at 10 and comprises an angle bar 12, a substantially flat elongated center member 14, a substantially flat elongated foot member 16, and a pair of hand-adjustable tightening elements 18 and 18'.

The angle bar 12 has an L-shaped cross section comprising a vertical portion 12A and a base portion 12B. The base portion 12B of the angle bar 12 is pivotally attached near its longitudinal center to one end of the center member 14 using tightening element 18. In addition, a bearing surface 12C is defined by the outside surface of the vertical portion 12A.

A slot 20 is disposed longitudinally down the middle of the center member 14. Through this slot 20, the center of foot member 16 is adjustably attached to the center member 14 by the second tightening element 18'. This, in turn, allows the angular and longitudinal orientation of the foot member 16 with respect to the center member 14 to be selectively adjusted by loosening the tightening element 18', moving the foot member 16 into the desired orientation, and tightening the element 18'.

Preferably, the angle bar 12, center member 14, and foot member 16 are comprised of a rigid metallic material such as steel. It is, however, well understood that virtually any other rigid material or combinations of materials can likewise be used to achieve the foregoing structure. It is important that the elements 12, 14 and 16 are flat (i.e., on the order of 0.125 inches) so that they lie relatively flat on the floor.

With regard to preferred dimensions, the angle bar 12 is preferably on the order of two feet long, with each portion 12A and 12B being approximately 1.25 inches wide. Similarly, the foot member 16 and center member 14 are on the order of two feet long and 1 inch wide. The slot 20 is preferably 15 inches long, and of a width to accommodate the shaft of the bolt cooperating with the wing nuts.

Figure 3:
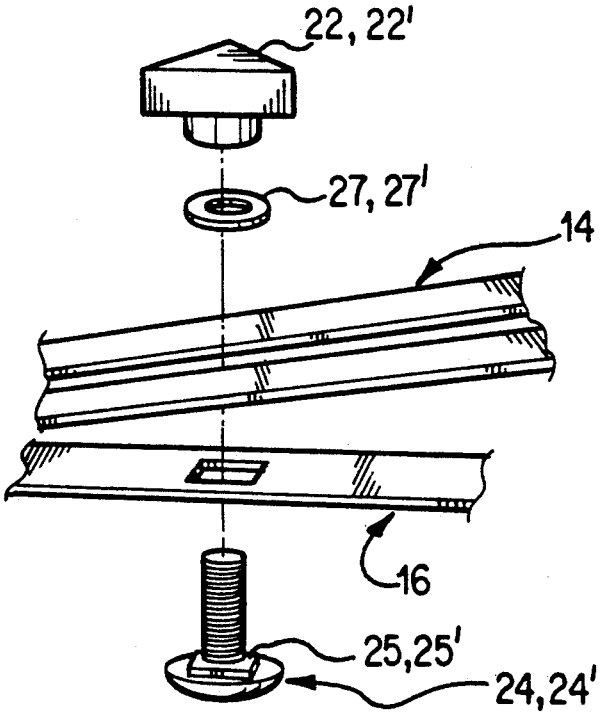
FIG. 3 is an exploded view illustrating the connection of the hand-adjustable tightening means for attaching the angle bar and foot member to the central member in accordance with the present invention.

With regard to the tightening elements 18 and 18', it is understood that many suitable tightening means exist. FIG. 3 illustrates a preferred embodiment of the hand-adjustable tightening elements 18 and 18'. In particular, each of the hand-adjustable tightening elements 18 and 18' comprises an internally threaded knob 22, 22' and a flat headed bolt 24, 24', each bolt having a flat 25, 25' to prevent rotation when the bolt is seated in slot 20. In the case of the tightening element 18, the flat headed bolt 24 protrudes through a square opening in the base portion 12B of the angle bar 12, through the slot 20 near one end of the center member 14, and threadedly engages the knob 22. In the case of the tightening element 18', the flat headed bolt 24' protrudes through a square opening in the center of the foot member 16, through the slot 20 in the center member 14, and threadedly engages the knob 22'. It is understood that the tightening elements 18 and 18' can further include conventional washers 27, 27'.

In this manner, a means is provided for selectively adjusting the angular orientation of each component 12, 14, and 16 with respect to the others and for adjusting the longitudinal position of the foot member 16 along the slot 20 in the central member 14.

Figure 4:
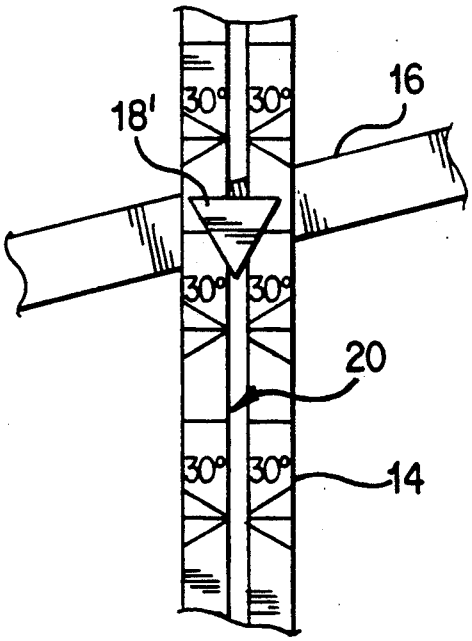
FIG. 4 illustrates indicia for setting the angle between the foot member and the central member.

As is illustrated in FIG. 1, the putting practice device 10 further includes sets of indices 25, 25' and 25'' which respectively gauge the back-stroke and follow-through of a putter head 32, the longitudinal position of the foot member 16 down the slot 20, and the location of a golfer's feet with respect to the foot member 16. Additional indices may also be used to denote the angular orientation of the foot member 16 with respect to the center member 14. FIG. 4, for example, illustrates a set of indices showing a 30 degree orientation from the perpendicular of the central member 14. Likewise, adjustable indicator pieces may be mounted along the top edge of the angle bar so as to indicate the desired length of the putter stroke along the angle bar 12.

In addition, three holes 12D, 12E, and 14A are provided for securing the device 10 to the ground. For example, holes 12D, 12E, and 14A could be sized to receive golf tees to hold device 10 in position on a putting green.

Functionally, the putting practice device 10 provides the golfer with a means for maintaining a desired and consistent putting stance, while at the same time ensuring that his/her putting stroke is a pure pendulum stroke containing no lateral motion.

With reference to FIGS. 1–4, the method for using the putting practice device 10 will now be described. Initially, from any convenient storage orientation, the tightening element 18 is loosened by turning the knob 22 in a counter-clockwise direction so that the center member 14 can be placed perpendicular to the angle bar 12. Once perpendicular, the tightened to secure the angular orientation of the center member 14.

The device 10 is next placed on the ground, and a golf ball 26 is placed adjacent the angle bar 12, with the line of angle bar 12 being placed parallel to the desired line of the putt, or trajectory T of the ball 26, but separated from the ball 26 by a predetermined distance. This predetermined distance is equal to that which separates the desired point of impact 28 ("sweet spot") on the face 30 of the putter head 32 from the heel 34 of the putter head 32. Although FIG. 2 shows this arrangement from a right-handed golfer's point of view, it is understood that the device 10 is symmetrical and can therefore be used by a left-handed golfer.

Once the device is placed on the ground in the foregoing manner, the other tightening element 18' is loosened, and the foot member 16 is positioned along the toes of the golfer so that while the heel 34 of the putter head 32 rests against the bearing surface 12C, the golfer assumes a stance which he/she finds most comfortable. This stance may be a closed stance whereby the golfer's forward foot is closer to the angle bar 12, an open stance whereby the golfer's back foot is closer to the angle bar 12, or a square stance where both feet are equidistant from the angle bar 12.

The golfer's foot positioning also can be moved left or right along the foot member 16, so that the ball can be centered, played back in the golfer's stance or played forward in the golfer's stance.

By consistently using the same ball positioning, foot positioning and distance from the ball, the golfer is able to repeat the same stroke for each of his/her putts.

In order to make a practice putt, the golfer assumes his/her stance, placing the heel 34 of the putter head 32 against the bearing surface 12C. Next, while maintaining contact between the heel 34 and the bearing surface 12C, the golfer putts the ball 26 in the direction of the desired trajectory T. By keeping the heel of the putter against the bearing surface 12C, the golfer is able to "groove" the pendulum stroke and thereby eliminate lateral motion from his/her putting stroke.

By repeating the foregoing method numerous times, particularly for putts of 15 feet or less, a golfer is able to train his muscles to assume a consistent stance and to effect a constant putting stroke when on the golf course.

Once the golfer has completed his practice, the tightening elements 18 and 18' can be loosened and the device 10 can be conveniently collapsed into the angular bar 12. Once collapsed, the device 10 fits easily into a conventional golf bag.

The foregoing description is intended by way of example only and is not intended to limit the present invention in any way except as set forth in the following claims.

I claim:

1. A collapsible putting practice device for eliminating lateral motion from a putting stroke and for assisting a golfer in maintaining a consistent stance and putting stroke, said putting practice device comprising:

an elongated L-shaped angle bar having a vertical portion and a base portion, wherein the outside, surface of said vertical portion defines a bearing surface for the heel of a putter;

an elongated foot member;

an elongated central member having a longitudinally disposed slot extending down the middle of said central member;

a first hand-adjustable tightening means for pivotally attaching said angle bar to said central member;

a second hand-adjustable tightening means for attaching said foot member to said central member at a selectively chosen position along the length of said central member and in a selectively chosen angular orientation with respect to said central member.

2. The collapsible putting practice device of claim 1, wherein said first hand-adjustable tightening means comprises:

a flat-headed bolt protruding through said base portion and through said slot in said central member; and an internally threaded knob for threadedly receiving said flat-headed bolt.

3. The collapsible putting practice device of claim 1, wherein said second hand-adjustable tightening means comprises:

a flat-headed bolt protruding through the center of said foot member and through said slot in said central member; and an internally threaded knob for threadedly receiving said flat-headed bolt.

4. The collapsible putting practice device of claim 1, and further comprising indices on said foot member for indicating golfer foot positioning.

5. The collapsible putting practice device of claim 4, and further comprising indicia on said foot member for indicating the angular orientation of said foot member with respect to said central member.

6. The collapsible putting practice device of claim 1, and further comprising indices on said central member for indicating the position of said foot member longitudinally down the slot in said central member.

7. The collapsible putting practice device of claim 1, and further comprising a plurality of tee holes for receiving conventional golf tees to thereby secure said putting practice device to the ground.

8. A putting practice device for eliminating lateral motion from a putting stroke and for assisting a golfer in maintaining a consistent stance and putting stroke, said putting practice device comprising:

an elongated L-shaped angle bar having a vertical portion and a horizontal base portion, wherein the outside surface of said vertical portion defines a bearing surface for the heel of a putter;

an elongated foot member;

an elongated central member having a longitudinally disposed slot extending down the middle of said central member, one end of said central member being connected to said angle bar near the center of said angle bar, said central member and said angle bar being perpendicular to one another; and a hand-adjustable tightening means for attaching said foot member to said central member at a selectively chosen position along the length of said central member and in a selectively chosen angular orientation with respect to the said central member.

9. The putting practice device of claim 8, wherein said hand-adjustable tightening means comprises:

a flat-headed bolt protruding through the center of said foot member and through said slot in said central member; and an internally threaded knob for threadedly receiving said flat-headed bolt.

10. The putting practice device of claim 8, and further comprising a series of indices for indicating golfer foot positioning, the length of stroke of a putter head, the angular orientation of said foot member with respect to said central member, and the position of said foot member longitudinally down the slot in said central member.

11. The putting practice device of claim 8, and further comprising a plurality of tee holes for receiving conventional golf tees to thereby secure said putting practice device to the ground.

12. The putting practice device of claim 8, and further comprising a series of indices on said central member for indicating the angle between said central member and said foot member.

13. A method for using a putting practice device having an elongated angle bar an elongated, a central member, and an elongated foot member to assist a golfer in maintaining a consistent putting stroke having no lateral motion and a consistent putting stance, said method comprising the steps of:

arranging said practice putting device on the ground such that one elongated surface of the angle bar is positioned vertically to form a bearing surface and said angle bar is parallel to an intended trajectory of a golf ball and the central member is perpendicular to the angle bar;

resting the heel of a putter head against said bearing surface on said angle bar;

placing a golf ball adjacent but spaced from said bearing surface by a distance corresponding to the "sweet spot" of the putter head;

assuming a comfortable putting stance, while said heel of the putter head remains against said bearing surface;

adjusting, in accordance with the foot positioning that results from said step of assuming a comfortable stance, the position and angular orientation of said foot member relative to the central member; and maintaining the heel of said putter head against said bearing surface while making putting strokes.

14. The method of claim 13, and further comprising the step of securing said putting practice device to the ground using conventional golf tees.

15. The method of claim 13, and further comprising the step of tightening connections between said angle bar, said central member, and said foot member to maintain the angular and positional orientation of each with respect to the others.

16. The method of claim 13, and further comprising locating "reminder" indices along the angle bar to indicate the desired length of the putting stroke.

* * * * *